US005639281A

United States Patent [19]

Hopkins

[11] Patent Number: 5,639,281

[45] Date of Patent: Jun. 17, 1997

[54] METHOD OF OBTAINING A UNIFORM SURFACE FINISH EFFECT ON FABRICS OR GARMENTS USING A GEL AND COMPOSITION THEREFOR

[75] Inventor: Gregory J. Hopkins, Rome, Ga.

[73] Assignee: Hopkins Chemical Incorporated, Rome, Ga.

[21] Appl. No.: 674,286

[22] Filed: Jul. 1, 1996

Related U.S. Application Data

[63] Continuation of Ser. No. 237,215, May 3, 1994, abandoned.

[51] Int. Cl.[6] ..... D06M 13/00; D06M 15/00

[52] U.S. Cl. ..... 8/115.6; 8/115.51; 8/181; 8/185; 8/186; 8/128.1; 8/128.3; 8/115.54; 8/115.56; 8/116.1; 8/115.57; 8/116.4; 427/242; 427/393.2; 427/393.1; 427/393.3; 427/393.4; 427/370; 427/338

[58] Field of Search ..... 8/115.6, 181, 185, 8/186, 128.1, 115.54, 115.56, 115.57, 552, 555, 557, 558, 559, 561, 562, 115.51, 116.1, 116.4, 128.3; 427/389, 389.1, 393.1, 393.2, 393.3, 393.4, 242, 370, 338

[56] References Cited

U.S. PATENT DOCUMENTS

| | | | |
|---|---|---|---|
| 2,541,457 | 2/1951 | Beer . | |
| 3,275,402 | 9/1966 | Daul et al. . | |
| 3,656,246 | 4/1972 | Lord . | |
| 3,709,657 | 1/1973 | Hollies et al. . | |
| 3,827,994 | 8/1974 | Cicione et al. | 8/185 |
| 3,871,817 | 3/1975 | Harper, Jr. et al. | 8/496 |
| 3,918,903 | 11/1975 | Kullman et al. . | |
| 4,108,598 | 8/1978 | Payet . | |
| 4,269,602 | 5/1981 | Worth et al. . | |
| 4,269,603 | 5/1981 | Worth . | |
| 4,472,167 | 9/1984 | Welch . | |
| 4,588,614 | 5/1986 | Lauchenauer | 427/243 |
| 4,614,519 | 9/1986 | Ruppert et al. | 8/137 |
| 4,737,156 | 4/1988 | Tambor et al. | 8/490 |
| 4,750,227 | 6/1988 | Hopkins et al. . | |
| 4,818,243 | 4/1989 | Chance et al. . | |
| 4,900,324 | 2/1990 | Chance et al. . | |
| 5,082,468 | 1/1992 | Hopkins . | |
| 5,162,042 | 11/1992 | Gyory et al. | 604/20 |
| 5,320,645 | 6/1994 | Logue et al. | 8/116.1 |
| 5,352,243 | 10/1994 | Ashizawa et al. | 8/401 |
| 5,443,835 | 8/1995 | Winston | 424/407 |
| 5,558,676 | 9/1996 | Gray et al. | 8/102 |

OTHER PUBLICATIONS

The Random House College Dictionary, 1968, p. 26.

*Primary Examiner*—Alan D. Diamond
*Attorney, Agent, or Firm*—Curtis, Morris & Safford P.C.; Barry Evans

[57] ABSTRACT

This invention relates to methods of applying finishes to garments. More particularly, this invention relates to improved methods for applying specialty finishing on the garments using a cellulose-type based carrier and to a carrier/finish composition for practicing the method which achieves a smooth and even coating of the finishing onto fabric without having to recover unused finishing and which can be accomplished using standard garment production equipment.

5 Claims, No Drawings

METHOD OF OBTAINING A UNIFORM SURFACE FINISH EFFECT ON FABRICS OR GARMENTS USING A GEL AND COMPOSITION THEREFOR

This application is a continuation of application Ser. No. 08/237,215, filed May 3, 1994 now abandoned.

FIELD OF THE INVENTION

This invention relates to methods of applying finishes to garments. More particularly, this invention relates to improved methods for applying an even and uniform coating of specialty finishes on the garments using a cellulose-type based carrier and to a gel composition for practicing the method. Cellulose-type based carrier is hereafter defined to include cellulose-type based carriers, as well as, natural gums such as starch, guar, xanthium, gharia, sodium alginate, locust bean gum, carboxymethyl cellulose, and hydroxypropyl cellulose, and synthetic gums such as polyacrylates.

BACKGROUND OF THE INVENTION

The textile industry has long used a variety of mechanical and chemical operations to give fabrics and garments their ultimate feel and performance characteristics. Recently, the textile industry has seen tremendous growth in the development of new finishes for garments, such as Prewash, Soft Hand, Stonewash, Bleach, Acid Wash, Garment Dye, and combinations thereof. With growth of new finishes for garments, the textile industry has also seen the reintroduction or resurgence of garments with durable press, shrink-proof, water-repellent, fire-retardant and soil release agents, and other specialty finishes.

For illustration purposes, the background will focus on the techniques and problems with applying durable press finishes to garments. A durable press finish allows a fabric or garment to be washed and dried by conventional methods and still recover or retain an ironed appearance without pressing. The same or similar techniques used in applying durable press finishes are also used in applying other finishes. Therefore, the background's focus on durable press finishes is not intended to limit the presently disclosed invention in any manner.

For many years, the textile industry has had applied durable press finishes to cotton and cotton blended fabrics. This finishing is done by the application and curing of one or more resins including melamine formaldehyde, urea formaldehyde, polycarboxylic acids, and dimethyloldihydroxyethylene urea. A finishing technique using formaldehyde is disclosed in U.S. Pat. No. 3,275,402 which relates to imparting crease recovery properties to cellulose fabrics by impregnating the fabrics (in the presence of water) with formaldehyde, a water-soluble metal salt, and a polymeric film forming stiffening material capable of reacting with formaldehyde, and curing the impregnated material to cross-link the cellulose and bond the film forming material to the cellulose.

The two standard techniques for applying durable press finishes to fabrics are the pre-cured technique and the post-cured technique. The pre-cured technique involves applying a pre-cured resin finish by padding on the finish, framing to width and drying on a finish frame (pin or clip), and curing in an oven. The post-cured technique is the same as the pre-cured technique except the curing step is omitted to prevent the finishing resin from cross-linking with the cotton. After a garment is made from post-cured fabric, it can be pressed and then cured in the pressed configuration so that creases, pleats, seams, belt loops, etc., maintain their "new" look and the panels of the garment remain smooth even after repeated laundering.

Whether using the pre-cured or post-cured technique on garments, the finishing resins are currently applied through the use of industrial washers. However, one of the primary problems with applying the finish is that durable press resins lack affinity for cotton. Thus, these durable press resins do not exhaust to the fabric as may certain dyes and chemicals. Therefore, using an industrial washing machine to apply resins is inefficient because it is necessary to run a liquor ratio (weight of liquid to weight of garments) of at least 4:1 in order to achieve uniform saturation. Assuming that the garments will be extracted to between about 50 to 100% percent total add on, four to eight times more resin has to be in the bath than is accepted by the garment. For example, if 5.0% resin is needed to achieve a desired finish, 40.0% resin would have to be added to a washer (assuming a 4:1 liquor ratio and extracting to 50.0% total add on). Since such large amounts of resins are necessary, it would be advantageous to recover the resin which is not accepted by the garment. However, it has been found that reclaiming the resin leads to contamination. Thus, most resins are wasted rather than recovered which makes this technique of applying finishing resin very costly.

In an attempt to overcome the inefficiency of using a washer for applying finishes to garments, other methods have been devised including the "Dip & Drip" method and the use of manufactured foam.

The "Dip & Drip" method is a slight improvement over the washer method. In this method, garments are collected in a water permeable bag, dipped in a resin finish mix, allowed to drip the excess finish back into the mix tank applicator, and then extracted. While the amount of unused finish mix has been greatly reduced, it is still a significant problem.

The method of using manufactured foam entails entraining the resin within a foam. Although manufactured foams are generally applied to piece goods by continuously metering a predetermined amount of foam on to the surface of the piece good, manufactured foams can also be applied using the washer method. Using a manufactured foam to apply finishes to garments does reduce waste, however the use of manufactured foam requires strict control of many process parameters and the purchase of expensive foaming equipment. A further disadvantage is that the finish may be distributed in a random and uneven fashion. Although this random and uneven distribution may be advantageous when it is desirable to create a blotchy effect on the fabric, such as when applying a dye to achieve a certain pattern, it is a disadvantage when applying finishing, such as durable press, shrink-proof, water-repellent, fire-retardant and soil release agents, and other specialty finishes, where coating the fabric evenly and smoothly is essential.

To truly become efficient, garment producers need a way to apply finishes to garments with no special equipment that distributes the finish evenly and smoothly with minimal or no wasted resin.

OBJECTS OF THE INVENTION

A primary object of this invention is to provide a composition and a method for coating fabrics of various fibers with a variety of finishing.

It is a further object of this invention to provide a composition and a method for coating fabrics which minimizes or eliminates any wasted finishing.

It is still a further object of this invention to provide a composition and a method for coating fabrics which results in even distribution of the finishing onto any fabric surface.

It is yet a further object of this invention to provide a composition and a method to achieve a smooth and even coating of the finishing onto fabric without having to recover unused finishing.

It is yet a further object of this invention to provide a composition and a method to achieve a smooth and even coating of the finishing onto fabric without having to recover unused finishing using standard garment production equipment.

The above and other objects, features and advantages of this invention will be apparent in the following detailed description of illustrative embodiments thereof.

SUMMARY OF THE INVENTION

This invention relates to improved methods for applying an even and uniform coating of a specialty finishing on garments using a cellulose-type based carrier and to a gel composition for practicing the method.

To overcome the numerous disadvantages of known finishing compositions and methods, cellulose-type based carriers mixed with solvents were developed to provide a cellulose-type based carrier with a specific rheology to carry specialty finishes with restricted wetting properties. The restricted wetting properties allow the cellulose-type based carrier to tumble with garments using an industrial washing machine or a tumbler, thereby spreading uniformly and wetting out the garments.

Of course, the viscosity and flow characteristics of the carrier depend on the components chosen and the amount used. Additionally, it is understood that the viscosity and flow characteristics of the carrier need to be adjusted according to fiber type and weight of the garment. However, excellent results have been achieved by using a mixture of hydroxyethylcellulose (HEC) and water.

The HEC/water mixture slowly hydrates to form a gelatinous substance (HEC gel) with a viscosity of about 12,000 cps which behaves as a lubricant and has a long flow rheology. Moreover, when the HEC gel is mixed with additional water or other liquids, the HEC gel does not immediately become homogeneous. A homogeneous solution is only formed after a considerable amount of time with high shear mixing.

Therefore, the HEC gel has characteristics which are advantageous for use as a carrier in applying a finish. The HEC gel has lubricant properties, long flow characteristics, slow hydration, and low solids content. These characteristics enable the HEC gel to spread evenly and uniformly on wet garments. Additionally, these characteristic permit the use of conventional garment treatment equipment, such as an industrial washing machine or a tumbler.

Although it is understood that numerous application methods can be utilized, the following is a general method for applying finishing to garments with a cellulose-type based carrier. First, a cellulose-type based carrier is formed, such as the HEC gel discussed above, with a specialty finishing added to form a carrier/finish mixture. Second, the garments are saturated with water. Third, the carrier/finish mixture is introduced to the garments and the garments are agitated. Fourth, the garments are tumble dried with subsequent cooling thereof. Finally, the garments are pressed and cured.

The present invention has achieved a composition and a method of using the composition for applying finishing on garments which is superior to any prior art teaching. The present invention achieves an even and uniform distribution of finishing, results in all or virtually all of the finishing being accepted by the garment (i.e. no waste problem), and requires no special equipment to apply the finishing. Additionally, it is surprising to find that despite the cellulose-type based carrier used, the performance of the finish and fabric texture and feel are not adversely affected.

A further advantage of the present invention is that this composition and method is not limited to cellulose-fiber containing fabrics nor is it limited to durable press resin as a finishing. This composition and method can be used in combination with any fabric and with any specialty finishing.

DETAILED DESCRIPTION OF THE INVENTION

As discussed previously, this invention relates to improved methods for applying an even and uniform coating of a specialty finishing on garments using a cellulose-type based carrier and to a gel composition for practicing the method.

Hydroxyethylcellulose (HEC) mixed with water has been found to produce a desirable cellulose-type based carrier for specialty finishes. A carrier/finish mixture is most preferably produced by mixing between about 0.5 to 5 wt % hydroxyethylcellulose, between about 5 to 50 wt % self-catalyzed modified glyoxal reactant (durable press finish), between about 0 to 15 wt % cationic-silicone softener (optional component to improve the texture and feel of the garment), and the remainder between about 45 to 94.5 wt % being water. This mixture slowly hydrates to form a gelatinous substance (HEC gel) with a viscosity of between about 11,000 to 13,000 cps which behaves as a lubricant and has a long flow rheology. Moreover, after the HEC gel has been formed it becomes somewhat hydrophobic, such that is takes a considerable amount of mixing at high shear to add additional water or other liquids.

Therefore, the HEC gel has characteristics which are advantageous for use as a carrier in applying a finish. The HEC gel has lubricant properties, long flow characteristics, slow hydration, and low solids content. These characteristics enable the HEC gel to spread evenly and uniformly on wet garments. Additionally, these characteristics permit the use of conventional garment treatment equipment, such as an industrial washing machine or a tumbler.

As discussed above, the present invention also relates to improved methods for applying an even and uniform coating of a specialty finishing on garments using a cellulose-type based carrier. It is understood that numerous application methods can be utilized to apply the cellulose-type based carrier, however the following is a preferred method for application. First, a cellulose-type based carrier is formed, such as the HEC gel discussed above, with a specialty finishing added to form a carrier/finish mixture. Second, the garments are immersed in water within a conventional washer, then the water is extracted in order to maintain between about 50 to 70% moisture in the garments. Third, an effective amount of carrier/finish mixture is added to the garments in the washer and the washer is run without additional water for between about 5 to 25 minutes. Fourth, the garments are tumble dried between about 140° to 180° F. with subsequent cooling thereof. Fifth, the garments are pressed on a hot-head press at a sufficient temperature and for a sufficient time to configure the garments prior to curing. Lastly, the garments are cured in a curing oven at between about 290° to 330° F. for between about 5 to 25 minutes.

It is to be understood that when reference is made to a garment herein it is meant that the garment is formed from any type of fabric. Thus, this invention is not limited to a cellulose-fiber containing fabric. In addition, one can substitute any type of finishing for this method as well as any type of gelatinous material as a carrier.

It is to be understood that the present process is not limited to garments, thus, piece goods may be used in place of the garments.

The type of finishing agents used in conjunction with this process are commercially available and may be selected according to the contents of the garments and weight used in fabricating the garments.

The following example is being presented not as a limitation but to illustrate and provide a better understanding of the invention, as well as to illustrate the importance of certain steps utilized in the present process.

EXAMPLE

A cellulose-type based carrier and finish mixture was produced by mixing 1.75% hydroxyethylcellulose, 20.00% Freedom Reactant 834™ (durable press finish—Freedom Reactant 834™ is a self-catalyzed modified glyoxal reactant supplied by Freedom Textile Chemicals Co., Charlotte, N.C.), 3.00% Romene Soft SS™ (optional component to improve the garment texture and feel—Romene Soft SS™ is a cationic-silicone softener blend from Hopkins Chemical Incorporated), and 75.25% water.

Eight pounds of garments made from 7½ oz. all cotton twill fabric were loaded into a conventional washer. The garments were rinsed in a sufficient quantity of water to completely saturate the garments for five minutes. Next, the water was extracted from the garments to leave approximately 60% moisture within the garments resulting in a garment weight after extraction of 12.8 pounds. The washer was then run without additional water for approximately two minutes to untangle the garments. Once the garments were untangled, 2 pounds of the cellulose-type based carrier and finish mixture were added to the garments in the washer and the washer was run without additional water for 15 minutes resulting in a garment weight of 14.8 pounds. It was observed that after 5 minutes the garments were approximately 95% covered and after the full 15 minutes, the garments were totally and evenly covered.

The differential between the weight of the garments before and after the addition of the cellulose-type based carrier and finish mixture was 2 pounds. This showed that all or virtually all of the cellulose-type based carrier and finish mixture was accepted by the garments with no waste.

The garments were then transferred to a conventional tumble dryer and run at 160° F. until dry and then tumbled until cool. The garments were then pressed on a hot-head press at a sufficient temperature and for a sufficient time to configure the garments prior to curing. Lastly, the garments were cured in an oven at 310° F. for 15 minutes.

The cured garments were then tested by AATCC Test Method 143-1992 for crease retention and fabric smoothness. The AATCC Test Method 143-1992 is designed for evaluating the smoothness appearance of flat fabric and seams, and the retention of pressed-in creases in garments and other textile products after repeated home laundering. The textile end product items are subjected to standard home laundering practices and evaluated using a standard lighting and viewing area by rating the appearance of specimens in comparison with appropriate reference standards.

The rating for the AATCC Test Method 143-1992 are as follows:

SA-1 Crumpled, creased and severely wrinkled appearance.

SA-2 Rumpled, obviously wrinkled appearance.

SA-3 Mussed, nonpressed appearance.

SA-3.5 Fairly smooth, but nonpressed appearance.

SA-4 Smooth, finished appearance.

SA-5 Very smooth, pressed, finished appearance.

The results on the test garments were SA-4 ratings. Additionally, fabric samples were taken from the cured garments and subjected to resin identification dyeing. This dyeing showed the resin to be fixed evenly to the fabric.

It is understood that the invention is not restricted to the detailed description of the invention, which may be modified without departure from the accompanying claims.

What is claimed is:

1. A method for evenly and uniformly applying a finish selected from the group consisting of durable press, shrink-proof, water-repellant, fire-retardant and soil release finishes to garments in conventional garment washing equipment comprising the steps of:

(a) forming a gelatinous carrier/finish mixture comprising:

(i) a carrier comprised of water and a natural or synthetic gum, and (ii) said finish;

(b) adding said gelatinous carrier/finish mixture to garments containing between about 50 to 70% by weight water in an industrial washer or tumbler;

(c) tumbling said garments and gelatinous carrier/finish mixture for a sufficient time to evenly and uniformly coat the garments with said carrier/finish mixture;

(d) drying the coated garments;

(e) pressing the dried garments; and (f) curing the pressed garments.

2. A method as recited in claim 1 wherein said gelatinous carrier/finish mixture is comprised of from 0.5 to 5.0% by weight hydroxyethylcellulose, from 5 to 50% by weight finish and from 45 to 94.5% by weight water.

3. A method for evenly and uniformly applying a durable-press finish to garments in a conventional garment washer or tumbler comprising the steps of:

(a) forming a gelatinous carrier/finish mixture comprising 0.5 to 5.0% by weight of hydroxyethylcellulose, from 5 to 50% by weight durable-press finish and from 45 to 94.5% by weight water;

(b) adding said gelatinous carrier/finish mixture to garments containing between about 50 to 70% by weight water in an industrial washer or tumbler;

(c) tumbling said garments and gelatinous carrier/finish mixture without additional water for between 5 and 25 minutes to evenly and uniformly coat the garments with said carrier/finish mixture;

(d) tumbling the coated garments at a temperature between about 140° F. and 180° F. to dry the coated garments and thereafter cooling the dried garments;

(e) pressing said dried garments; and (f) curing the pressed garments.

4. A method as recited in claim 3 wherein the carrier/finish mixture has a viscosity of between about 11,000 to 13,000 cps at room temperature.

5. A method as recited in claim 3 wherein the garments are tumbled for from 5 to 15 minutes to evenly coat them with said carrier/finish mixture.

* * * * *